US011680358B2

(12) United States Patent
Carpenter

(10) Patent No.: US 11,680,358 B2
(45) Date of Patent: Jun. 20, 2023

(54) LAUNDRY PEDESTAL HAVING A DRAWER

(71) Applicant: WHIRLPOOL CORPORATION, Benton Harbor, MI (US)

(72) Inventor: Scott E. Carpenter, Sawyer, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 294 days.

(21) Appl. No.: 17/091,074

(22) Filed: Nov. 6, 2020

(65) Prior Publication Data

US 2021/0189633 A1 Jun. 24, 2021

Related U.S. Application Data

(60) Provisional application No. 62/949,680, filed on Dec. 18, 2019.

(51) Int. Cl.

| | |
|---|---|
| ***A47B 88/413*** | (2017.01) |
| ***D06F 39/12*** | (2006.01) |
| ***A47B 83/00*** | (2006.01) |
| ***E04F 11/06*** | (2006.01) |

(52) U.S. Cl.

CPC ..... *D06F 39/125* (2013.01); *A47B 83/00* (2013.01); *E04F 11/068* (2013.01); *A47B 2220/04* (2013.01)

(58) Field of Classification Search

CPC ..... D06F 39/125; D06F 39/12; D06F 29/00; D06F 39/001; D06F 58/20; A47B 83/00; A47B 2220/04; A47B 2210/17; A47B 88/413; A47B 2220/05; E04F 11/068

See application file for complete search history.

(56) References Cited

U.S. PATENT DOCUMENTS

| | | | | |
|---|---|---|---|---|
| 7,313,933 | B2 | 1/2008 | Carey et al. | |
| 7,587,917 | B2 | 9/2009 | Gilboe et al. | |
| 10,316,584 | B1 * | 6/2019 | Cooper | E06C 1/005 |
| 2012/0055039 | A1 | 3/2012 | Watson et al. | |
| 2015/0033786 | A1 | 2/2015 | Mansfield et al. | |
| 2018/0070722 | A1 | 3/2018 | Yang et al. | |
| 2018/0340282 | A1 * | 11/2018 | Kim | D06F 1/04 |

FOREIGN PATENT DOCUMENTS

| | | | |
|---|---|---|---|
| EP | 1577434 | A2 | 9/2005 |
| KR | 20090102413 | A | 9/2009 |
| WO | 2016193376 | A1 | 12/2016 |
| WO | 2018040206 | A1 | 3/2018 |

* cited by examiner

*Primary Examiner* — Terrell L McKinnon
*Assistant Examiner* — Jerry Olivier
(74) *Attorney, Agent, or Firm* — Price Heneveld LLP

(57) ABSTRACT

A laundry pedestal for supporting a laundry treating appliance includes a cabinet having a top wall, opposing side walls, and a base, and a drawer configured to be moved between a retracted position and an extended position relative to the cabinet. The drawer includes a first compartment having a first cover and a second compartment, adjacent to the first compartment, and having a second cover. A height of the second compartment is greater than a height of the first compartment.

17 Claims, 5 Drawing Sheets

LAUNDRY PEDESTAL HAVING A DRAWER

CROSS-REFERENCE TO RELATED APPLICATIONS

This application claims priority to U.S. Patent No. 62/949,680, filed on Dec. 18, 2019, entitled "LAUNDRY PEDESTAL HAVING A DRAWER," the disclosure of which is hereby incorporated herein by reference in its entirety.

BACKGROUND OF THE DISCLOSURE

The present disclosure generally relates to a laundry pedestal having a drawer, and more specifically, to a laundry pedestal having a drawer that provides a step for a user to climb.

Front loading laundry treating appliances, such as clothes washers and dryers, are often installed on a platform or pedestal that raises the appliance above the floor. Raising the appliance above the floor can provide several benefits. For example, raising the appliance above the floor can provide room for storage underneath the appliance. In another example, raising the appliance above the floor elevates the appliance door such that an interior of the appliance can be accessed with less bending or stooping by a user of the appliance.

SUMMARY OF THE DISCLOSURE

According to an aspect of the present disclosure, a laundry pedestal for supporting a laundry treating appliance includes a cabinet having a top wall, opposing side walls, and a base, and a drawer configured to be moved between a retracted position and an extended position relative to the cabinet. The drawer includes a first compartment having a first cover and a second compartment, adjacent to the first compartment. The second compartment includes a second cover that is vertically offset above the first cover, wherein a height of the second compartment is greater than a height of the first compartment.

According to another aspect of the present disclosure, a laundry pedestal for supporting a laundry treating appliance includes a cabinet having a top wall, opposing side walls, and a base. The laundry pedestal includes a pair of first and second steps configured to be moved between a retracted position and an extended position relative to the cabinet. The first step includes a first compartment having a first cover. The second step includes a second compartment having a second cover that is vertically offset above the first cover, wherein a height of the second compartment is greater than a height of the first compartment. The first cover defines a first tread of the first step and the second cover defines a second tread of the second step.

According to yet another aspect of the present disclosure, a laundry treating appliance includes a first cabinet housing a treating chamber for treating laundry according to a cycle of operation and a second cabinet, disposed beneath the first cabinet, the second cabinet including a top wall, opposing side walls, and a base. The laundry treating appliance includes a drawer configured to be moved between a retracted position and an extended position relative to the second cabinet. The drawer includes a first compartment having a first cover and a second compartment, adjacent to the first compartment. The second compartment includes a second cover that is vertically offset above the first cover, wherein a height of the second compartment is greater than a height of the first compartment.

These and other features, advantages, and objects of the present disclosure will be further understood and appreciated by those skilled in the art by reference to the following specification, claims, and appended drawings.

Figure 1:
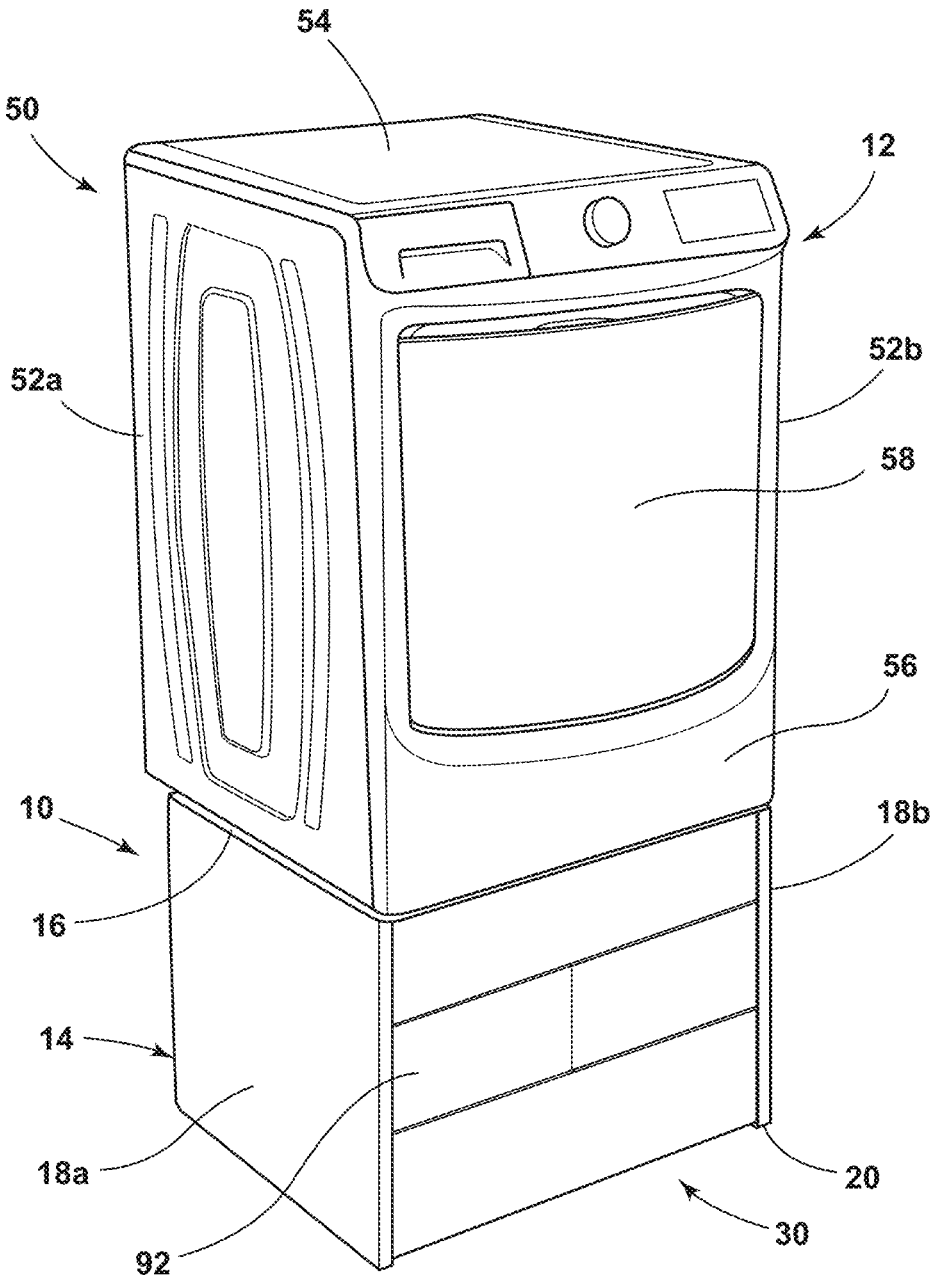
FIG. 1 is a front perspective view of a laundry treating appliance and a laundry pedestal having a drawer in a retracted position, according to an aspect of the present disclosure.

The components in the figures are not necessarily to scale, emphasis instead being placed upon illustrating the principles described herein.

DETAILED DESCRIPTION

The present illustrated embodiments reside primarily in combinations of apparatus components relating to a laundry pedestal having a drawer that provides first and second steps for a user to climb and which also provides compartments which may be used for storage. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates a laundry pedestal 10 configured to support a laundry treating appliance 12. The laundry pedestal 10 includes a pedestal cabinet 14 having a top wall 16, opposing side walls 18*a*, 18*b*, and a base 20. The laundry pedestal 10 also includes a drawer 30 that is configured to be moved between a closed or retracted position (FIG. 1) and an open or extended position (FIG. 2) relative to the pedestal cabinet 14. The drawer 30 can include a first compartment 32 having a first cover 34. The drawer 30 also includes a second compartment 40, adjacent to the first compartment 32, which has a second cover 42 that is vertically offset above the first cover. The drawer 30 can be configured such that a height of the second compartment 40 is greater than a height of the first compartment 32. According to an aspect of the present disclosure, the first compartment 32 forms a first step and the second compartment 40 forms a second step, disposed above the first step, such that a user can ascend and descend one or both steps.

Figure 2:
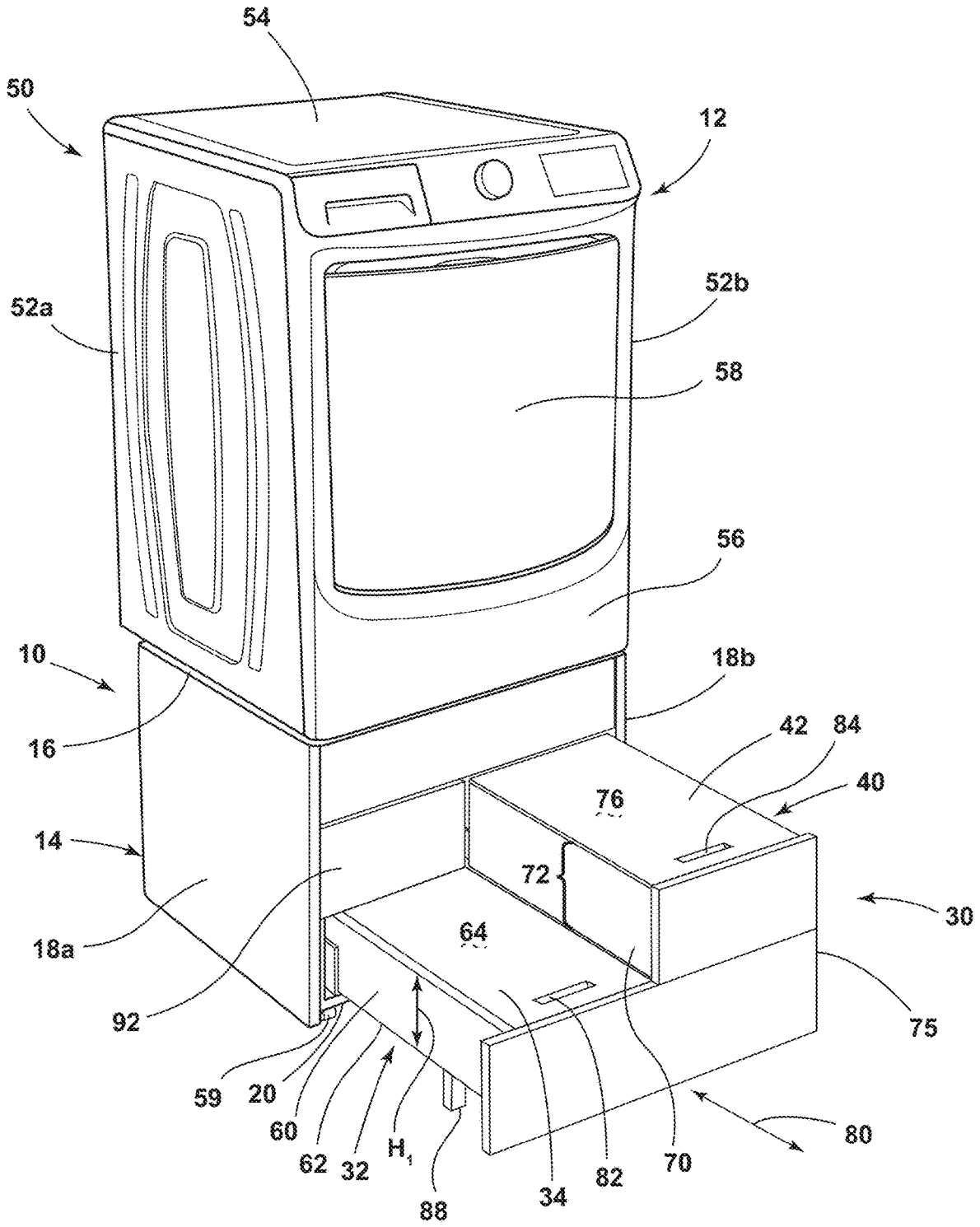
FIG. 2 is a front perspective view of the laundry treating appliance and the laundry pedestal of FIG. 1 with the drawer in an extended position, according to an aspect of the present disclosure.

Referring to FIGS. 1-2, the laundry treating appliance 12 includes an appliance cabinet 50 having a pair of opposing side walls 52*a*, 52*b*, a top wall 54, and a front wall 56. The laundry treating appliance 12 also includes a door 58 that is moveable between open and closed positions to provide access to a treating chamber of the laundry treating appliance that is configured to treat laundry according to a cycle of operation. The laundry treating appliance 12 can include additional components found in a conventional laundry treating appliance that are not described for the sake of brevity, examples of which include a tub, drum, treating chemistry dispenser, a user interface, a motor, a drain pump, a heating element, etc. The laundry treating appliance 12 can be any type of laundry treating appliance, examples of which include a clothes washer, a clothes dryer, a condensing dryer, a combination washer and dryer, or a revitalizing appliance. While aspects of the present disclosure are illustrated and discussed in the context of a front-loading appliance, also referred to as a horizontal axis appliance, it is within the scope of the present disclosure for the laundry pedestal 10 to be utilized with a top-loading appliance (also referred to as a vertical axis appliance).

The pedestal cabinet 14 can be configured to have sufficient strength to support the intended laundry treating appliance 12 and the drawer 30. The appliance cabinet 50 can also be configured to have sufficient strength to support the components of the appliance. Examples of suitable materials for forming the pedestal cabinet 14 and the appliance cabinet 50 include metal, metal alloys, steel, steel alloys, aluminum, wood, polymeric materials, composite materials, and combinations thereof. The pedestal cabinet 14 can be made from the same or different materials as the appliance cabinet 50. The pedestal cabinet 14 and appliance cabinet 50 may each include suitable structural supports based on the intended use of each. In one example, the pedestal cabinet 14 can include supporting feet 59 configured to support the pedestal cabinet 14 on a supporting surface on which the pedestal cabinet 14 is installed (e.g., a floor). Optionally, the supporting feet 59 may be adjustable to allow for leveling of the pedestal cabinet 14 on the supporting surface.

According to one aspect of the present disclosure, the laundry pedestal 10 and the laundry treating appliance 12 are individual units, each having their own respective cabinets 14 and 50. In another aspect of the present disclosure, portions of the pedestal cabinet 14 and the appliance cabinet 50 may be coupled together or integrally formed. For example, the side walls 18*a*, 18*b* of the pedestal cabinet 14 can be coupled together or integrally formed with the adjacent side walls 52*a*, 52*b* of the appliance cabinet 50.

Figure 3:
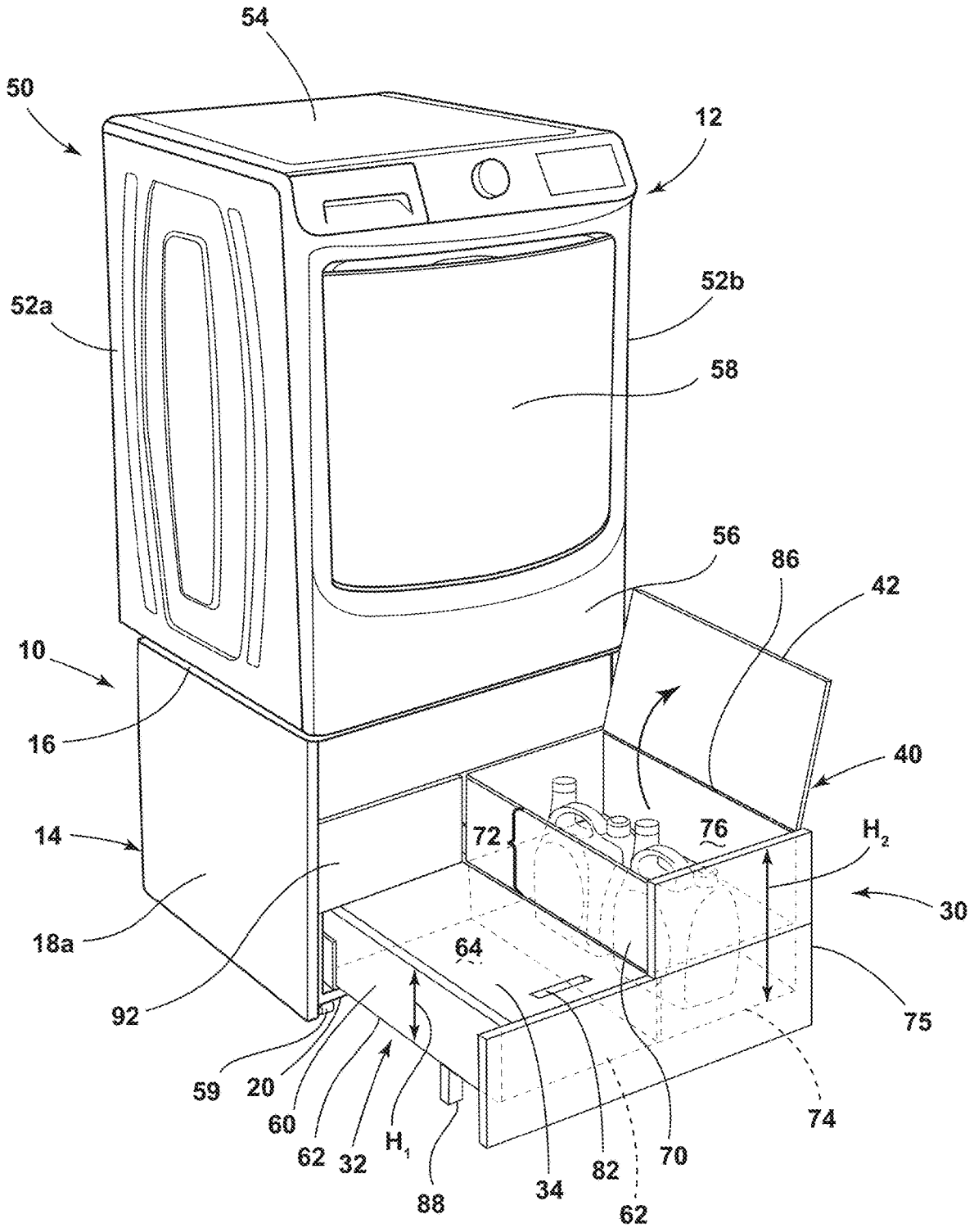
FIG. 3 is a front perspective view of a laundry treating appliance and a laundry pedestal having a drawer in an extended position in which a cover of a compartment of the drawer is in an open position, according to an aspect of the present disclosure.

Referring now to FIGS. 2-3, the illustrated first compartment 32 includes a first side wall 60 that may also be referred to as a first riser 60 and a first bottom wall 62. The first riser 60, first bottom wall 62, and the first cover 34 at least partially define a first cavity 64 of the first compartment 32. A vertical height of the first riser 60 between the first bottom wall 62 and the first cover 34 defines a height $H_1$ of the first compartment 32.

As illustrated, the second compartment 40 includes a second side wall 70 that is adjacent to the first compartment 32 and includes a portion 72, which can also be referred to as a second riser 72, which extends vertically between the first cover 34 and the second cover 42. The second compartment 40 also includes a bottom wall 74 and an outer wall 75, which, together with the second side wall 70 and the second cover 42, at least partially define a second cavity 76. In one aspect, the second side wall 70 may be a shared wall between the first and second compartments 32 and 40 that separates the first cavity 64 from the second cavity 76. In another aspect, the first compartment 32 may include its own side wall opposite the first riser 60, which, together with the first riser 60, bottom wall 62, and first cover 34, at least partially define the first cavity 64. In another aspect, the second side wall 70 may only extend between the second cover 42 and the first cover 34. The second compartment 40 can have a vertical height $H_2$ defined as a distance between the bottom wall 74 and the cover 42.

Each of the first and second covers 34 and 42 can be configured to move between an open and closed position to selectively allow access to the first and second cavities 64 and 76, respectively. In one example, illustrated in FIG. 2, one or both of the first and second covers 34 and 42 can be configured to linearly slide, as indicated by arrows 80, between open and closed positions. Optionally, the first and/or second covers 34, 42 can be provided with a handle element to facilitate moving the cover between open and closed positions. For example, the first and/or second covers 34, 42 can include an opening 82, 84, respectively, that a user can grasp to move the respective cover between the open and closed positions. Other types of handle elements, such as a rib, ring, knob, or pull, may also be used. The first and second covers 34, 42 can be linearly slidable between the open and closed positions using any suitable system, such as a slide rail system, a roller system, or a track, for example.

In another example, as illustrated in FIG. 3, one or both of the first and second covers 34 and 42 can include a hinge that allows the cover to be rotated between the open and closed positions. For example, the second cover 42 can be coupled with the outer side wall 75 by a hinge 86 for rotation about the hinge 86 between open and closed positions. In one aspect, the hinge 86 can be coupled with the second cover 42 such that the entire body of the second cover 42 moves between the open and closed positions (as illustrated). In another aspect, the hinge 86 may be disposed within the body of the second cover 42 such that only a portion of the second cover 42 moves between the open and closed positions. In another aspect, the second cover 42 may be divided into two or more parts that may be individually moveable between the open and closed positions to provide access to the second cavity 76. The first cover 34 may be divided into two or more parts that may be individually moveable between the open and closed positions to provide access to the second cavity 79. The first cover 34 can be configured in a manner that is similar or different than the second cover 42.

Referring again to FIG. 2, the drawer 30 can be moveable between the retracted and extended positions using any suitable slide system. For example, the drawer 30 can be coupled to the pedestal cabinet 14 using any suitable slide rail system, such as a ball bearing slide rail system. The slide system can be coupled with the drawer 30 along the first riser 60 and the outer wall 75 or along the bottom walls 62 and 74 of the respective first and second compartments 32, 40.

In one aspect of the present disclosure, the drawer 30 can optionally include one or more support elements 88 projecting from one or both of the bottom walls 62 and 74 of the first and second compartments 32, 40, respectively. The support element 88 can be configured to contact the supporting surface that the laundry pedestal 10 is installed on (e.g., the floor) to support a weight of the drawer 30 and a weight of a user or other item.

In one aspect, the support element 88 can be configured to always contact the supporting surface. In another aspect, the support element 88 can be configured to contact the supporting surface when a predetermined amount of weight is placed on the drawer 30. For example the support element 88 may be a wheel or sliding element that contacts the supporting surface and facilitates movement of the drawer 30 between the retracted and extended positions. In another example, the support element 88 can be a leg that abuts the supporting surface.

The components forming the drawer 30 can be configured to be capable of supporting the weight of a user standing on the first and second compartments 32, 40 as well as the weight of items stored within the first and/or second compartments 32, 40. For example, the materials forming the first and second compartments 32, 40 and the drawer slide system can be selected to provide the drawer 30 with sufficient strength to support a desired weight or weight range. For example, the first and second compartments 32, 40 can be made from materials having a desired strength, such as wood, metal, polymeric, or composite materials. The type, number, and/or placement of the support element 88 can be selected in combination with the other components of the drawer 30 to provide the drawer 30 with the desired strength to support a user and stored items. In one aspect, the drawer 30 is configured to support at least about 79 kilograms (kg). For example, the drawer 30 can be configured to support at least about 79 kg, at least about 90 kg, at least about 102 kg, at least about 113 kg, at least about 124 kg, or at least about 136 kg.

The pedestal cabinet 14 can optionally include components in addition to the drawer 30. In one example, the pedestal cabinet 14 can include a second drawer 92 configured to store items (FIG. 2), and which is moveable between open and closed positions. In another example, the pedestal cabinet 14 can include a shelf that is moveable between extended and retracted positions relative to the pedestal cabinet 14 for supporting an item thereon, such as a laundry basket (not shown).

Figure 4:
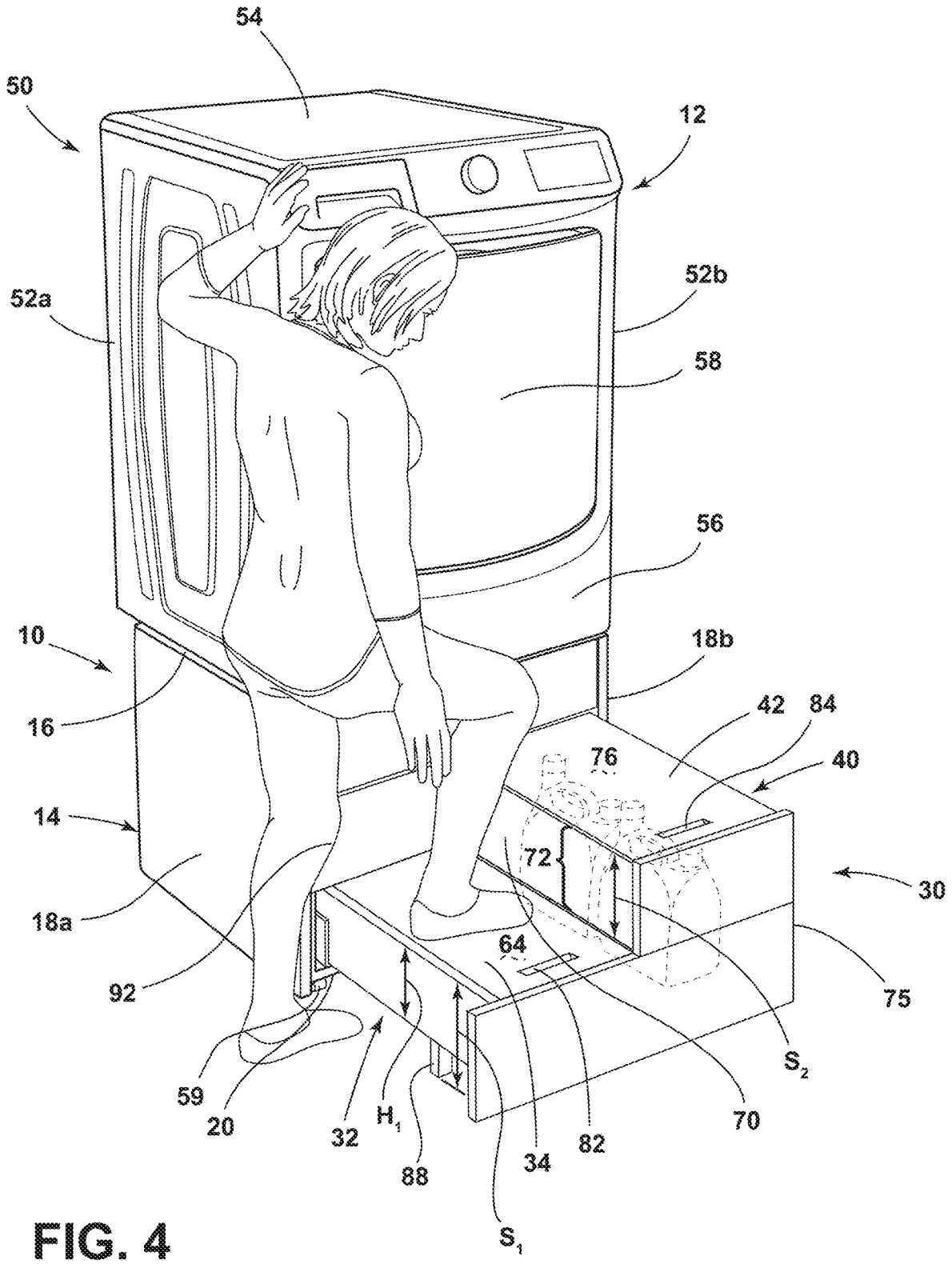
FIG. 4 is a front perspective view of a user and the laundry treating appliance and laundry pedestal of FIG. 1 with the drawer in an extended position, according to an aspect of the present disclosure.

Referring now to FIG. 4, in use, the drawer 30 can be moved into the extended position to provide a user with first and second steps that can be climbed by the user. The first compartment 32 can provide the user with a first step and the second compartment 40 can provide the user with a second step, vertically offset above the first step. In this manner, the first and second covers 34 and 42 can act as first and second treads of the first and second steps, respectively, that a user can step on when ascending/descending the steps. In one aspect, the first and second covers 34 and 42 can optionally include a non-slip component that facilitates providing friction between a user's feet/footwear and the first and second covers 34, 42. For example, the first and second covers 34, 42 can be provided with a non-slip material, such as natural or synthetic rubber or a polymeric material. In another example, the non-slip component can include structural features configured to decrease the likelihood of a user slipping, such as raised nubs, ribs, bumps, etc. The structural features may be included directly in an upper surface of the first and second cover 34, 42 or in a secondary material that is disposed on an upper surface of the first and second cover 34, 42. In one example, the first and second covers 34, 42 can include a metal, metal alloy, polymeric, or composite surface, having raised serrations, perforations, and/or ribs to decrease the likelihood of a user slipping when ascending/descending the steps. In another example, both a non-slip material and structural features may be provided on the first and second covers 34, 42 to decrease the likelihood of a user slipping when ascending/descending the steps. One or both of the first and second covers 34, 42 may be provided with a non-slip component. In one aspect, the non-slip component on the first and second covers 34, 42 may be the same or different.

In one aspect, the drawer 30 can be configured to provide first and second steps each having a desired step height. A step height $S_1$ of the first step corresponds to a distance of the first cover 34 of the first compartment 32 above the supporting surface upon which the laundry pedestal 10 is installed. It is understood that when the laundry pedestal 10 includes adjustable supporting feet 59, the step height $S_1$ may vary. A step height $S_2$ of the second step corresponds to a distance of the second cover 42 of the second compartment 40 above the first cover 34, which corresponds to a height of the second riser 72. In one example, the step height $S_1$ of the first step and the step height $S_2$ of the second step may be from about 17 centimeters (cm) to about 26 cm. For example, the step height $S_1$ of the first step and the step height $S_2$ of the second step may be from about 17 cm to about 26 cm, about 17 cm to about 24 cm, about 17 cm to about 22 cm, about 17 cm to about 20 cm, about 20 cm to about 26 cm, about 20 cm to about 24 cm, or about 22 cm to about 26 cm. The first and second step heights $S_1$ and $S_2$ may be the same or different.

Figure 5:
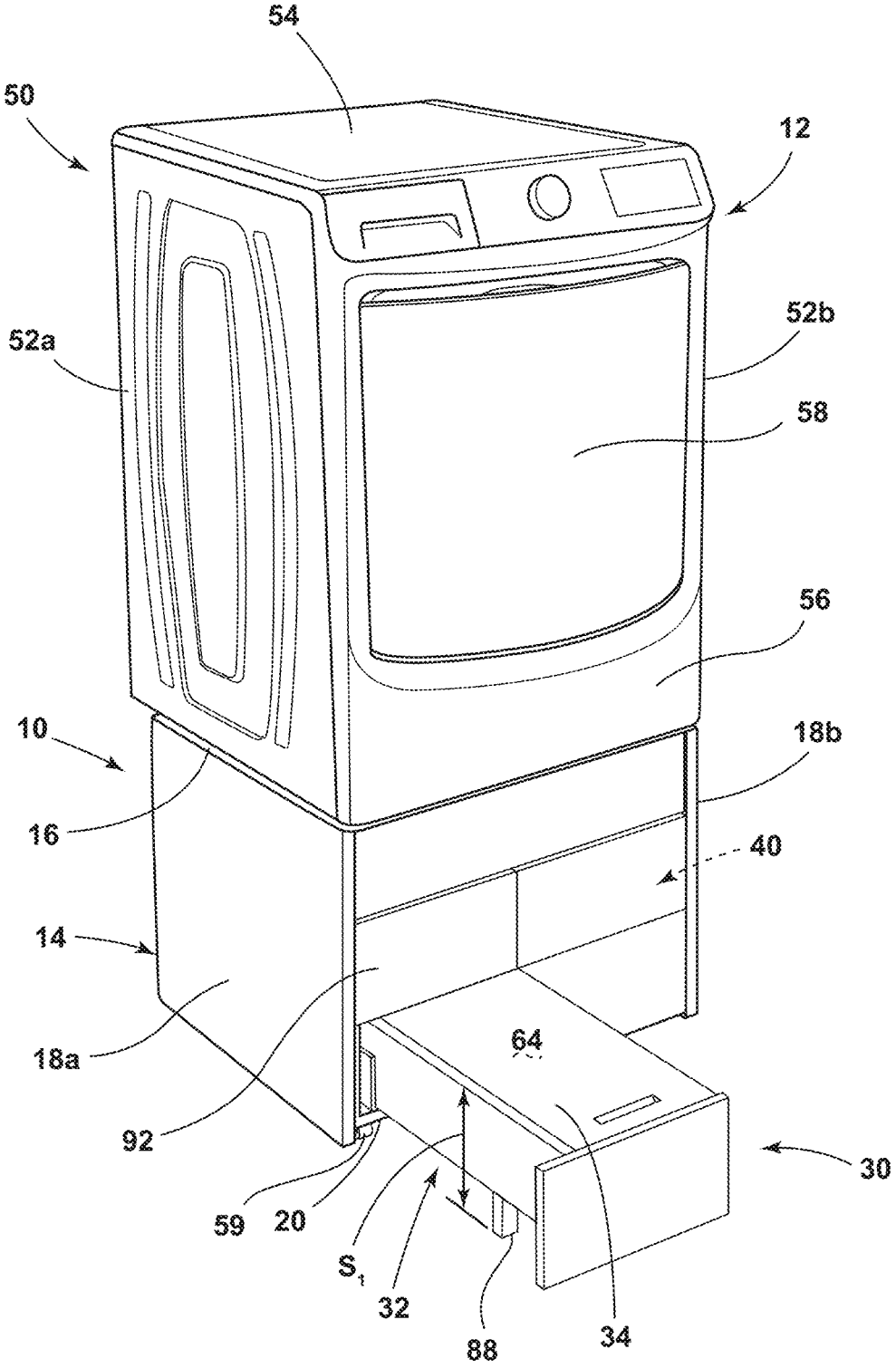
FIG. 5 is a front perspective view of a laundry treating appliance and a laundry pedestal having a drawer in which a portion of the drawer is an extended position and a portion of the drawer is in a retracted position, according to an aspect of the present disclosure.

As illustrated in FIG. 4, the drawer 30 can be configured such that both the first and second compartments 32, 40 (i.e., the first and second steps) move between the retracted and extended positions as a single unit. In one aspect, the drawer 30 can be configured such that one or both of the first and second compartments 32, 40 move independently of the other of the first and second compartments 32, 40. For example, as illustrated in FIG. 5, the first compartment 32 can be configured to move between the retracted and extended positions independently of the second compartment 40. In this manner, a user can access just the first compartment 32, either for use as a step or to gain access to the first cavity 64, independently of the second compartment 40. In this configuration, the first compartment 32 includes a slide system that allows the first compartment 32 to move without a corresponding movement of the second compartment 40. Optionally, the second compartment 40 can be configured to move between the retracted and extended positions independent of the first compartment 32. In this configuration, the second compartment 40 would also include a slide system that allows the second compartment 40 to move without a corresponding movement of the first compartment 32.

According to another aspect of the present disclosure, the drawer 30 can be configured such that movement of the second compartment 40 between the retracted and extended positions results in a corresponding movement of the first compartment 32. For example, the second compartment 40 can include a catch element that engages the first compartment 32 and induces a corresponding movement of the first compartment 32 when the second compartment 40 is moved between the retracted and extended positions. In this manner, the drawer 30 can be configured such that whenever the second compartment 40 is in the extended position, the first compartment 32 is also in the extended position. Optionally, the first compartment 32 can be configured to move back into the retracted position independently of the second compartment 40.

The first and second steps can facilitate allowing a user to access and/or view items stored on or above the laundry treating appliance 12. For example, a user may have items stored on the top wall 54 of the appliance cabinet 50 and/or on shelving or cabinetry installed above the appliance cabinet 50. In another example, the first and second steps can facilitate allowing a user to view inside a laundry treatment dispensing drawer disposed above the door 58. The drawer 30 is configured to provide a user with two steps that can provide a user with two height options above the supporting surface. The two height options can facilitate assisting users of different heights (e.g., the average human female is shorter than the average human male). The two height options can also provide a user with more options to access and/or view areas at different heights above the supporting surface. In addition to facilitating allowing a user to access and/or view items stored on or above the laundry treating appliance 12, the drawer 30 is also configured to provide a user with storage space.

As illustrated in FIGS. 1-5, the drawer 30 is configured such that the first compartment 32 is disposed between the first pedestal cabinet side wall 18*a* and the second compartment 40 and the second compartment 40 is disposed between the second side wall 18*b* and the first compartment 32. In this manner, the first and second risers 60 and 72 extend generally parallel with respect to the first and second pedestal cabinet side walls 18*a*, 18*b*. In this configuration, the laundry treating appliance 12 will be adjacent to a user as the user ascends/descends the first and second steps (i.e., the first and second compartments 32, 40, respectively). As illustrated in FIG. 4, this allows the user to grasp or hold the laundry treating appliance 12 for support as the user ascends/descends the first and second steps. The user could also approach the steps from the front of the laundry treating appliance 12, if desired. It will be understood that the drawer 30 can be configured such that a user approaches the first step from the left side of the laundry treating appliance 12 (as illustrated in FIG. 4) or the configuration of the drawer 30 can be reversed such that a user approaches the first step from the right side of the laundry treating appliance 12. For example, the drawer 30 can be configured such that the first compartment 32 is disposed between the second pedestal cabinet side wall 18*b* and the second compartment 40 and the second compartment 40 is disposed between the first side wall 18*a* and the first compartment 32. In other words, the drawer 30 can be configured as a left-handed configuration in which the user ascends/descends the first step with the laundry treating appliance on the user's left (as illustrated in FIG. 4) or as a right-handed configuration in which the user ascends/descends the first step with the laundry treating appliance 12 on the user's right. The right or left-handed configuration of the drawer 30 may be selected for any suitable reason, such as a desired aesthetic, the direction in which the door 58 of the laundry treating appliance 12 opens/closes, the location of a dispenser drawer (e.g., when the dispenser drawer is located at a top left-handed corner, the drawer 30 may be configured in the right-handed configuration or vice versa to facilitate the ability of a user to ascend the steps and view inside the dispenser drawer), etc.

While FIGS. 1-5 illustrate the drawer 30 being configured such that the first and second risers 60 and 72 extend generally parallel with respect to the first and second pedestal cabinet side walls 18*a*, 18*b*, it is also within the scope of the present disclosure for the drawer 30 to be configured such that the first and second risers 60 and 72 extend generally perpendicular to the first and second pedestal cabinet side walls 18*a*, 18*b*. In this manner, a user approaching the laundry treating appliance 12 from the front would encounter the first compartment 32 (i.e., the first step) first and the second compartment 40 (i.e., the second step) would be disposed between the first compartment 32 and the front of the laundry treating appliance 12.

Non-limiting aspects of the present disclosure are set forth below:

According to a first aspect of the present disclosure, a laundry pedestal for supporting a laundry treating appliance includes: a cabinet including a top wall, opposing side walls, and a base; and a drawer configured to be moved between a retracted position and an extended position relative to the cabinet, the drawer including: a first compartment having a first cover; and a second compartment, adjacent to the first compartment, and having a second cover that is vertically offset above the first cover, wherein a height of the second compartment is greater than a height of the first compartment.

According to a second aspect of the present disclosure, the laundry pedestal of the first aspect, wherein the first cover, the second cover, or both the first and second cover are configured to one of linearly slide between open and closed positions or rotate about a hinge axis between open and closed positions.

According to a third aspect of the present disclosure, the laundry pedestal of the first aspect, wherein a vertical distance between the first cover and the second cover is from about 17 centimeters to about 26 centimeters.

According to a fourth aspect of the present disclosure, the laundry pedestal of the first aspect, wherein the first compartment is configured to move independently of the second compartment between the retracted and extended positions.

According to a fifth aspect of the present disclosure, the laundry pedestal of the first aspect, wherein the second compartment is configured such that movement of the second compartment between the retracted and extended positions results in a corresponding movement of the first compartment between the retracted and extended positions, respectively.

According to a sixth aspect of the present disclosure, the laundry pedestal of the first aspect, wherein in the retracted position, the first compartment is disposed between a first wall of the opposing side walls and the second compartment and the second compartment is disposed between a second wall of the opposing side walls and the first compartment.

According to a seventh aspect of the present disclosure, the laundry pedestal of the first aspect, further including: at least one support element extending from an underside of the drawer.

According to an eighth aspect of the present disclosure, a laundry pedestal for supporting a laundry treating appliance includes: a cabinet including a top wall, opposing side walls, and a base; a pair of first and second steps configured to be moved between a retracted position and an extended position relative to the cabinet, wherein the pair of first and second steps comprise; a first compartment having a first cover; and a second compartment having a second cover that is vertically offset above the first cover, wherein a height of the second compartment is greater than a height of the first compartment, and wherein the first cover defines a first tread of the first step and the second cover defines a second tread of the second step.

According to a ninth aspect of the present disclosure, the laundry pedestal of the eighth aspect, wherein the first compartment and the second compartment are at least partially defined by a first riser of the first step and a second riser of the second step, respectively, and wherein the first riser and the second riser are aligned substantially parallel with the opposing side walls.

According to a tenth aspect of the present disclosure, the laundry pedestal of the eighth aspect, wherein the first cover, the second cover, or both the first and second cover are configured to one of linearly slide between open and closed positions or rotate about a hinge axis between open and closed positions.

According to an eleventh aspect of the present disclosure, the laundry pedestal of the eighth aspect, wherein a vertical distance between the first cover and the second cover is from about 17 centimeters to about 26 centimeters.

According to a twelfth aspect of the present disclosure, the laundry pedestal of the eighth aspect, wherein the first compartment is configured to move independently of the second compartment between the retracted and extended positions.

According to a thirteenth aspect of the present disclosure, the laundry pedestal of the eighth aspect, wherein the second compartment is configured such that movement of the second compartment between the retracted and extended positions results in a corresponding movement of the first compartment between the retracted and extended positions, respectively.

According to a fourteenth aspect of the present disclosure, the laundry pedestal of the eighth aspect, wherein an upper surface of the first cover, the second cover, or both the first and second cover includes one of a rubber material, polymeric material, metal material, metal alloy material, composite material, or combinations thereof.

According to a fifteenth aspect of the present disclosure, the laundry pedestal of the eighth aspect, further including: at least one support element extending from an underside of one of the first compartment, the second compartment, or the first and second compartments.

According to a sixteenth aspect of the present disclosure, a laundry treating appliance includes: a first cabinet housing a treating chamber for treating laundry according to a cycle of operation; a second cabinet, disposed beneath the first cabinet, the second cabinet including a top wall, opposing side walls, and a base; and a drawer configured to be moved between a retracted position and an extended position relative to the second cabinet, the drawer including: a first compartment having a first cover; and a second compartment, adjacent to the first compartment, and having a second cover that is vertically offset above the first cover, wherein a height of the second compartment is greater than a height of the first compartment.

According to a seventeenth aspect of the present disclosure, the laundry treating appliance of the sixteenth aspect, wherein the first cover, the second cover, or both the first and second cover are configured to linearly slide between open and closed positions or rotate about a hinge axis between open and closed positions.

According to an eighteenth aspect of the present disclosure, the laundry treating appliance of the sixteenth aspect, wherein a vertical distance between the first cover and the second cover is from about 17 centimeters to about 26 centimeters.

According to a nineteenth aspect of the present disclosure, the laundry treating appliance of the sixteenth aspect, wherein the first compartment is configured to move independently of the second compartment between the retracted and extended positions.

According to a twentieth aspect of the present disclosure, the laundry treating appliance of the sixteenth aspect, wherein the second compartment is configured such that movement of the second compartment between the retracted and extended positions results in a corresponding movement of the first compartment between the retracted and extended positions, respectively.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry pedestal for supporting a laundry treating appliance, comprising:

a cabinet including a top wall, opposing side walls, and a base; and a drawer configured to be moved between a retracted position and an extended position relative to the cabinet, the drawer comprising:

a first compartment having a first cover; and a second compartment, adjacent to the first compartment, and having a second cover that is vertically offset above the first cover, wherein a height of the second compartment is greater than a height of the first compartment, wherein the second compartment is configured such that movement of the second compartment between the retracted and extended positions results in a corresponding movement of the first compartment between the retracted and extended positions, respectively.

2. The laundry pedestal of claim 1, wherein the first cover, the second cover, or both the first and second cover are configured to one of linearly slide between open and closed positions or rotate about a hinge axis between open and closed positions.

3. The laundry pedestal of claim 1, wherein a vertical distance between the first cover and the second cover is from about 17 centimeters to about 26 centimeters.

4. The laundry pedestal of claim 1, wherein the first compartment is configured to move independently of the second compartment between the retracted and extended positions.

5. The laundry pedestal of claim 1, wherein in the retracted position, the first compartment is disposed between a first wall of the opposing side walls and the second compartment and the second compartment is disposed between a second wall of the opposing side walls and the first compartment.

6. The laundry pedestal of claim 1, further comprising:

at least one support element extending from an underside of the drawer.

7. A laundry pedestal for supporting a laundry treating appliance, comprising:

a cabinet including a top wall, opposing side walls, and a base;

a pair of first and second steps configured to be moved between a retracted position and an extended position relative to the cabinet, wherein the pair of first and second steps comprise:

a first compartment having a first cover; and a second compartment having a second cover that is vertically offset above the first cover, wherein a height of the second compartment is greater than a height of the first compartment, and wherein the first cover defines a first tread of the first step and the second cover defines a second tread of the second step, wherein the second compartment is configured such that movement of the second compartment between the retracted and extended positions results in a corresponding movement of the first compartment between the retracted and extended positions, respectively.

8. The laundry pedestal of claim 7, wherein the first compartment and the second compartment are at least partially defined by a first riser of the first step and a second riser of the second step, respectively, and wherein the first riser and the second riser are aligned substantially parallel with the opposing side walls.

9. The laundry pedestal of claim 7, wherein the first cover, the second cover, or both the first and second cover are configured to one of linearly slide between open and closed positions or rotate about a hinge axis between open and closed positions.

10. The laundry pedestal of claim 7, wherein a vertical distance between the first cover and the second cover is from about 17 centimeters to about 26 centimeters.

11. The laundry pedestal of claim 7, wherein the first compartment is configured to move independently of the second compartment between the retracted and extended positions.

12. The laundry pedestal of claim 7, wherein an upper surface of the first cover, the second cover, or both the first and second cover comprises one of a rubber material, polymeric material, metal material, metal alloy material, composite material, or combinations thereof.

13. The laundry pedestal of claim 7, further comprising:

at least one support element extending from an underside of one of the first compartment, the second compartment, or the first and second compartments.

14. A laundry treating appliance, comprising:

a first cabinet housing a treating chamber for treating laundry according to a cycle of operation;

a second cabinet, disposed beneath the first cabinet, the second cabinet comprising a top wall, opposing side walls, and a base; and a drawer configured to be moved between a retracted position and an extended position relative to the second cabinet, the drawer comprising:

a first compartment having a first cover; and a second compartment, adjacent to the first compartment, and having a second cover that is vertically offset above the first cover, wherein a height of the second compartment is greater than a height of the first compartment, wherein the second compartment is configured such that movement of the second compartment between the retracted and extended positions results in a corresponding movement of the first compartment between the retracted and extended positions, respectively.

15. The laundry treating appliance of claim 14, wherein the first cover, the second cover, or both the first and second cover are configured to linearly slide between open and closed positions or rotate about a hinge axis between open and closed positions.

16. The laundry treating appliance of claim 14, wherein a vertical distance between the first cover and the second cover is from about 17 centimeters to about 26 centimeters.

17. The laundry treating appliance of claim 14, wherein the first compartment is configured to move independently of the second compartment between the retracted and extended positions.

* * * * *